US012207784B2

(12) United States Patent
Hong et al.

(10) Patent No.: US 12,207,784 B2
(45) Date of Patent: Jan. 28, 2025

(54) ROBOTIC CLEANER

(71) Applicant: LG ELECTRONICS INC., Seoul (KR)

(72) Inventors: Woo Hong, Seoul (KR); Sangik Lee, Seoul (KR); Jongho Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 485 days.

(21) Appl. No.: 17/627,277

(22) PCT Filed: Jun. 2, 2020

(86) PCT No.: PCT/KR2020/007103
§ 371 (c)(1),
(2) Date: Jan. 14, 2022

(87) PCT Pub. No.: WO2021/040195
PCT Pub. Date: Mar. 4, 2021

(65) Prior Publication Data

US 2022/0354325 A1 Nov. 10, 2022

(30) Foreign Application Priority Data

Aug. 26, 2019 (KR) ..... 10-2019-0104661

(51) Int. Cl.
*A47L 9/04* (2006.01)
*A47L 5/34* (2006.01)
*A47L 9/06* (2006.01)

(52) U.S. Cl.
CPC ..... *A47L 9/0494* (2013.01); *A47L 9/066* (2013.01); *A47L 5/34* (2013.01); *A47L 2201/00* (2013.01)

(58) Field of Classification Search
CPC ..... A47L 9/0494; A47L 9/066; A47L 5/34; A47L 2201/00; A47L 9/0666; A47L 9/0455; A47L 9/0427
See application file for complete search history.

(56) References Cited

U.S. PATENT DOCUMENTS 5,014,387 A 5/1991 Hays

FOREIGN PATENT DOCUMENTS

| | | |
|---|---|---|
| CN | 203987865 | 12/2014 |
| CN | 107397506 | 11/2017 |
| EP | 2092869 | 8/2009 |
| JP | 2016-036427 | 3/2016 |

(Continued)

OTHER PUBLICATIONS

International Search Report dated Nov. 27, 2020 issued in Application No. PCT/KR2020/007103.

(Continued)

*Primary Examiner* — David Redding
(74) *Attorney, Agent, or Firm* — KED & ASSOCIATES, LLP

(57) ABSTRACT

The present invention relates to a robotic cleaner comprising: a cleaner body which has a plurality of guide holders provided therein and performs self-driving; and a suction nozzle which receives an agitator therein, has guide protrusions longitudinally protruding from both sidewalls thereof toward the plurality of guide holders and received in the plurality of guide holders, respectively, and is up-and-down movably and back-and-forth swingably mounted to the cleaner body, whereby the driving performance and cleaning performance of the cleaner can be improved.

17 Claims, 11 Drawing Sheets

(56) References Cited

FOREIGN PATENT DOCUMENTS

| | | |
|---|---|---|
| KR | 20-1989-0012596 | 8/1989 |
| KR | 93-13828 | 7/1993 |
| KR | 20-1994-0000350 | 1/1994 |
| KR | 10-2010-0088454 | 8/2010 |
| KR | 10-2013-0107642 | 10/2013 |
| KR | 10-2017-0099627 | 9/2017 |

OTHER PUBLICATIONS

Chinese Office Action issued in Application No. 202080059662.X dated Jul. 25, 2022.

ROBOTIC CLEANER

CROSS-REFERENCE TO RELATED PATENT APPLICATIONS

This application is a U.S. National Stage Application under 35 U.S.C. § 371 of PCT Application No. PCT/KR2020/007103, filed Jun. 2, 2020, which claims priority to Korean Patent Application No. 10-2019-0104661, filed Aug. 26, 2019, whose entire disclosures are hereby incorporated by reference.

TECHNICAL FIELD

The present disclosure relates to a robot cleaner capable of improving driving performance and cleaning performance by easily responding to a change in a floor surface on a driving path.

BACKGROUND ART

A robot cleaner is a device that sucks foreign substances such as dust from a floor while driving by itself in a zone to be cleaned.

The robot cleaner includes a suction nozzle module, and the suction nozzle module comes into contact with a surface to be cleaned to suck foreign substances such as dust present on the surface together with air. In particular, the robot cleaner is mainly operated in a floor environment.

Meanwhile, in the robot cleaner, a height difference in a floor may occur depending on various types of floor environments while driving in a state in which the suction nozzle is fixed thereto.

For example, there exist various types of driving environments, such as a floor board, a hardwood floor, a door frame, a tile, a rug, and a carpet, and the like, on which the robot cleaner drives.

However, since a robot cleaner in the related art drives in a state in which the suction nozzle is in close contact with the floor, the suction nozzle may be stuck due to a height difference for each type of floor.

For example, in an environment such as a carpet, depending on a degree of softness of the floor, drive wheels of the robot may descend below a floor surface, and the suction nozzle may be stuck by the carpet.

Due to the suction nozzle being stuck, there occurs a problem in that driving performance is lowered.

That is, there occurs a problem in that a frictional force between the drive wheel and the floor is reduced to cause the slippage of the drive wheel, and a driving load of the wheels is increased to reduce a driving time of the robot cleaner and lower a quality thereof.

Moreover, there occurs a problem in that a rotational speed of a rotating brush is reduced due to an increase in a load of the brush and the like, and cleaning performance is lowered.

In order to reduce such a stuck phenomenon, Korean Patent Application No. 10-2017-0099627 A (published on Sep. 1, 2017) discloses a suction structure of a robot cleaner that ascends or descends according to a state of a floor surface.

The robot cleaner includes first and second support portions protruding from one side of a suction portion and spaced apart in a length direction. Ends of the first support portion and the second support portion define a rotation shaft according to the ascent or descent of the suction portion. Accordingly, as the suction portion may rotate so as to be ascendable or descendable about the rotation shaft disposed at the ends of the first and second support portions, it may ascend or descend according to the state of the floor surface.

However, the prior patent application requires that the robot cleaner in the related art implements a climbing angle varying operation that assists in climbing an obstacle in addition to an ascending/descending operation of the suction nozzle.

DISCLOSURE OF INVENTION

Technical Problem

The present disclosure is contrived to solve the problem of the related art, and a first aspect of the present disclosure is to provide a robot cleaner capable of easily responding to a change in a height of a floor to improve driving performance, and implementing an operation to assist in climbing an obstacle.

A second aspect of the present disclosure is to provide a robot cleaner capable of maintaining a surface pressure of a suction nozzle and increasing a suction pressure thereof even when there is a large height difference in the floor, thereby improving cleaning performance.

Solution to Problem

In order to achieve the foregoing first object, a robot cleaner may include a cleaner body provided with a plurality of guide holders therein to drive autonomously; and a suction nozzle provided with guide protrusions protruding from both sidewalls in a length direction toward the plurality of guide holders, respectively, to be accommodated inside the plurality of guide holders, respectively, and mounted to be ascendable/descendable and swingable in a front-rear direction with respect to the cleaner body.

According to an example associated with the present disclosure, each of the plurality of guide holders may include a guide groove disposed on one surface facing the guide protrusion to accommodate the guide protrusion, and configured to guide the guide protrusion to perform a top-down movement and a rotational operation in a front-rear direction.

According to an example associated with the present disclosure, a plurality of first guide surfaces extending in parallel in a top-down direction to be brought into contact with one of both side surfaces in a front-rear direction of the guide protrusion so as to limit a front-rear rotation angle of the guide protrusion; and a plurality of second guide surfaces that connect upper and lower ends of each of the plurality of first guide surfaces to be brought into contact with one end portion of both end portions in a top-down direction of the guide protrusion so as to limit a top-down movement distance of the guide protrusion.

According to an example related to the present disclosure, each of the plurality of first guide surfaces may be defined in a planar shape, and each of the plurality of second guide surfaces may be defined in an arc-shaped curved surface shape.

According to an example related to the present disclosure, the guide protrusion may include a lower curved surface disposed in an arc shape to be slidably rotate along a circumferential direction at an inner side of the guide groove; an upper curved surface disposed in an arc shape having a diameter smaller than that of an arc of the lower curved surface, and disposed to be spaced apart upward from the lower curved surface; and a plurality of inclined surfaces connecting both ends of each of the lower curved surface and the upper curved surface.

According to an example related to the present disclosure, the guide groove may be disposed to have a constant width from the lower portion to the upper portion of the guide holder, and the guide protrusion may decrease in width from the lower portion to the upper portion of the guide holder.

According to an example related to the present disclosure, the guide groove may decrease in width from a lower portion to an upper portion of the guide holder, and the guide protrusion may be defined in a circular shape.

According to an example related to the present disclosure, the guide groove may be disposed to have a constant width from the lower portion to the upper portion of the guide holder, and the guide protrusion may increase in width from the lower portion to the upper portion of the guide holder.

According to an example related to the present disclosure, the robot cleaner may further include a protruding portion protruding upward from a bottom surface of the cleaner body and provided with a communication hole communicating with a floor surface on a driving path at an inner side thereof, and the plurality of guide holders may be mounted on both sidewalls of the protruding portion, respectively.

According to an example related to the present disclosure, slide grooves slidably coupled to both sidewalls of the protruding portion may be disposed on both side surfaces of each of the plurality of guide holders.

According to an example related to the present disclosure, it may be configured with a structure in which left and right end portions of the suction nozzle are independently ascendable/descendable from each other with respect to the cleaner body.

According to an example related to the present disclosure, a tapered portion may be disposed in an inclined manner or a round portion may be disposed in a rounded manner at each of the front and rear end portions at a lower portion of the suction nozzle.

In order to achieve the foregoing second object, a robot cleaner according to the present disclosure may include a cleaner body provided with a plurality of guide holders therein to drive autonomously; and a suction nozzle that accommodates an agitator thereinside, provided with guide protrusions protruding from both sidewalls in a length direction toward the plurality of guide holders, respectively, to be accommodated inside the plurality of guide holders, respectively, and mounted to be ascendable/descendable and swingable in a front-rear direction with respect to the cleaner body, wherein each of the plurality of guide holders is provided with a guide groove that guides the guide protrusion to perform a top-down movement and a rotational operation in a front-rear direction, wherein the guide protrusion includes a lower curved surface disposed in an arc shape to slidably rotate along a circumferential direction at an inner side of the guide groove; an upper curved surface defined in an arc shape having a diameter smaller than that of an arc of the lower curved surface, and spaced apart from the lower curved surface in an upward direction; and a plurality of inclined surfaces connecting both ends of each of the lower curved surface and the upper curved surface, and wherein during the swing of the suction nozzle, the upper curved surface rotates in a front-rear direction around the lower curved surface at an inner side of the guide groove.

According to an example related to another aspect of the present disclosure, the guide groove may include a lower guide surface defined in an arc shape having a size corresponding to that of the lower curved surface; an upper guide surface spaced apart from the lower guide surface in an upward direction than a height between the lower curved surface and the upper curved surface, and defined in an arc shape having a diameter larger than that of the upper curved surface; and a plurality of rotation limiting guide surfaces connecting both ends of each of the lower guide surface and the upper guide surface to limit a front-rear direction rotation angle of the guide protrusion.

According to an example related to another aspect of the present disclosure, when the guide protrusion ascends from the lower guide surface to the upper guide surface, the upper curved surface may rotationally move along a circumferential direction from one end of the upper guide surface toward a top peak of an arc, and a swinging operation of the suction nozzle may be automatically adjusted to be horizontal.

According to this configuration, the suction nozzle may be automatically adjusted to be horizontal when the suction nozzle ascends at a boundary portion where a height difference in the floor is large, thereby maintaining a surface pressure of the suction nozzle and improving a suction pressure thereof.

A robot cleaner according to another embodiment of the present disclosure may include a cleaner body provided with a plurality of guide protrusions protruding from both sidewalls therein to drive autonomously; and a suction nozzle that accommodates an agitator thereinside, provided with guide grooves concavely disposed on both sidewalls in a length direction to accommodate the plurality of guide protrusions, respectively, and mounted to be ascendable/descendable and swingable in a front-rear direction with respect to the cleaner body.

According to an example related to another embodiment of the present disclosure, the robot cleaner may further include a buffer member on an outer surface of the guide protrusion to relieve an impact when brought into contact with the guide groove.

Advantageous Effects of Invention

The effects of a robot cleaner according to the present disclosure will be described as follows.

First, a guide protrusion may be slidably mounted in a top-down direction while being accommodated in a guide groove to allow a suction nozzle to be ascendable/descendable with respect to a cleaner body according to a change in a height of the floor, thereby improving driving performance.

Second, front and rear surfaces of the guide protrusion may be disposed to be inclined with respect to front and rear surfaces of the guide groove, thereby allowing the guide protrusion to be rotatable in a front-rear direction with respect to a cleaner body while being accommodated in the guide groove.

Therefore, the suction nozzle may be swingable in a front-rear direction with respect to the cleaner body, so that when the robot cleaner moves forward and backward, a climbing angle of the suction nozzle varies so as to be actively operated even with a large change in a height difference of a floor surface, thereby further improving driving performance.

Third, when the guide protrusion ascends to a top peak of the guide groove, a circular upper curved surface of the guide protrusion may rotate to the top peak along an upper second guide surface while inscribed in the upper second guide surface of the guide groove defined in a circular shape having a larger diameter.

Therefore, the suction nozzle may be automatically adjusted from an inclined state to a horizontal state by rotationally moving the guide protrusion in a vertical direction from a swing state of the guide protrusion at the top peak of the guide groove, thereby maintaining a surface pressure of the suction nozzle and improving suction performance.

MODE FOR THE INVENTION

Figure 1:
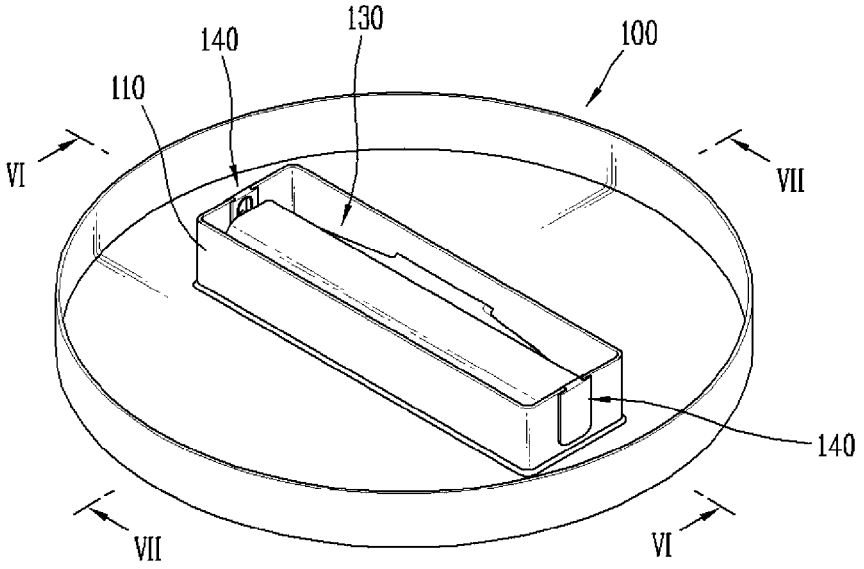
FIG. 1 is a conceptual view showing a state in which a suction nozzle according to the present disclosure is mounted on a bottom surface of a robot cleaner.

Hereinafter, the embodiments disclosed herein will be described in detail with reference to the accompanying drawings, and the same or similar elements are designated with the same numeral references regardless of the numerals in the drawings and redundant description thereof will be omitted. A suffix "module" and "unit" used for constituent elements disclosed in the following description is merely intended for easy description of the specification, and the suffix itself does not give any special meaning or function. In describing the embodiments disclosed herein, moreover, the detailed description will be omitted when specific description for publicly known technologies to which the invention pertains is judged to obscure the gist of the present disclosure. Also, it should be understood that the accompanying drawings are merely illustrated to easily explain the concept of the invention, and therefore, they should not be construed to limit the technological concept disclosed herein by the accompanying drawings, and the concept of the present disclosure should be construed as being extended to all modifications, equivalents, and substitutes included in the concept and technological scope of the invention.

It will be understood that, although the terms first, second, etc. may be used herein to describe various elements, these elements should not be limited by these terms. The terms are used merely for the purpose to distinguish an element from the other element.

In case where an element is "connected" or "linked" to the other element, it may be directly connected or linked to the other element, but another element may be existed therebetween. On the contrary, in case where an element is "directly connected" or "directly linked" to the other element, it should be understood that any other element is not existed therebetween.

A singular representation may include a plural representation as far as it represents a definitely different meaning from the context.

Terms "include" or "has" used herein should be understood that they are intended to indicate the existence of a feature, a number, a step, a constituent element, a component or a combination thereof disclosed in the specification, and it may also be understood that the existence or additional possibility of one or more other features, numbers, steps, constituent elements, components or combinations thereof are not excluded in advance.

Figure 2:
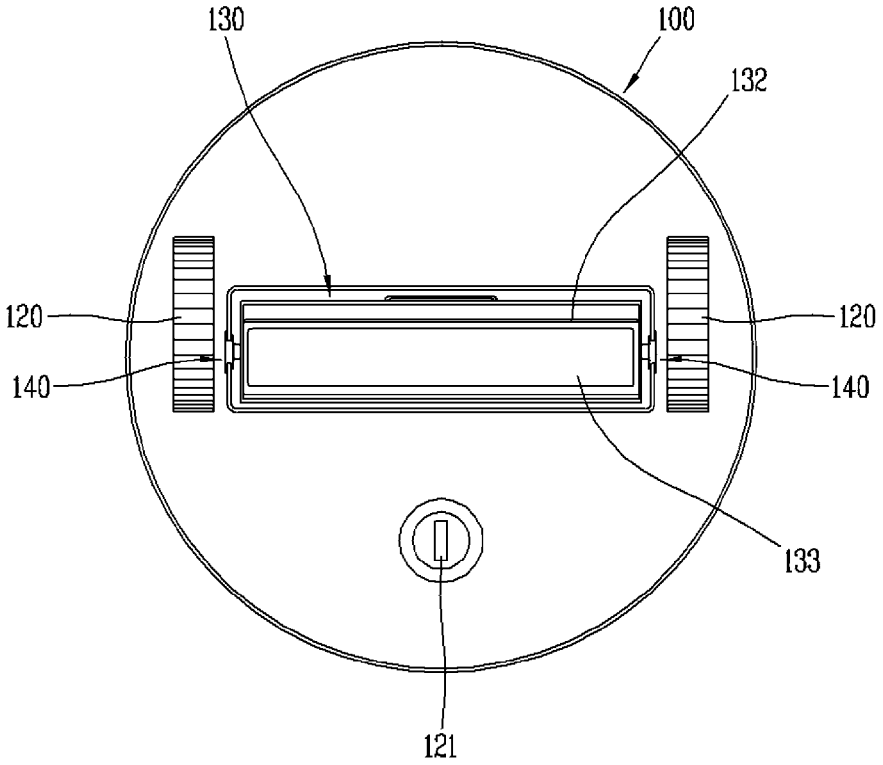
FIG. 2 is a bottom view showing a bottom surface of the robot cleaner mounted with the suction nozzle in FIG. 1.

FIG. 1 is a conceptual view showing a state in which a suction nozzle 130 according to the present disclosure is mounted on a bottom surface of a robot cleaner. FIG. 2 is a bottom view showing a bottom surface of the robot cleaner 130 operates mounted with the suction nozzle in FIG. 1.

The robot cleaner includes a cleaner body 100, a wheel unit, and a suction nozzle 130.

The cleaner body 100 defines an appearance of the robot cleaner. The cleaner body 100 may be defined in a flat cylindrical shape having a relatively small height compared to a diameter.

The wheel unit may include a plurality of drive wheels 120 and an auxiliary wheel 121. The plurality of drive wheels 120 are rotatably mounted on the cleaner body 100 for the movement of the robot cleaner. The plurality of drive wheels 120 are configured such that the robot cleaner autonomously drives. The plurality of drive wheels 120 may be disposed to be spaced apart from each other at both left and right sides of the cleaner body 100.

A wheel drive motor may be connected to each of the plurality of drive wheels 120. The wheel drive motor is configured to independently drive each of the plurality of drive wheels 120. As a rotational speed of the wheel drive motor is controlled, each of the drive wheels 120 at left and right sides may be rotated at different speeds. As each of the plurality of drive wheels 120 is independently driven, steering such as left and right turning and forward/backward operation of the robot cleaner may be carried out.

The auxiliary wheel 121 may be rotatably provided at a front or rear side of the cleaner body 100. The auxiliary wheel 121 serves to assist the drive wheels 120 to facilitate the steering of the cleaner body 100.

The protruding portion 110 may be disposed to protrude upward from a bottom surface of the cleaner body 100. The protruding portion 110 may be defined in a rectangular box shape with a large length in left and right lateral directions of the cleaner body 100.

A communication hole may be disposed inside the protruding portion 110. The communication hole may be passed therethrough to communicate with a floor surface on a driving path of the robot cleaner in a top-down direction.

The suction nozzle 130 is accommodated inside the protruding portion 110. The suction nozzle 130 is mounted on a bottom surface of the cleaner body 100.

Figure 3:
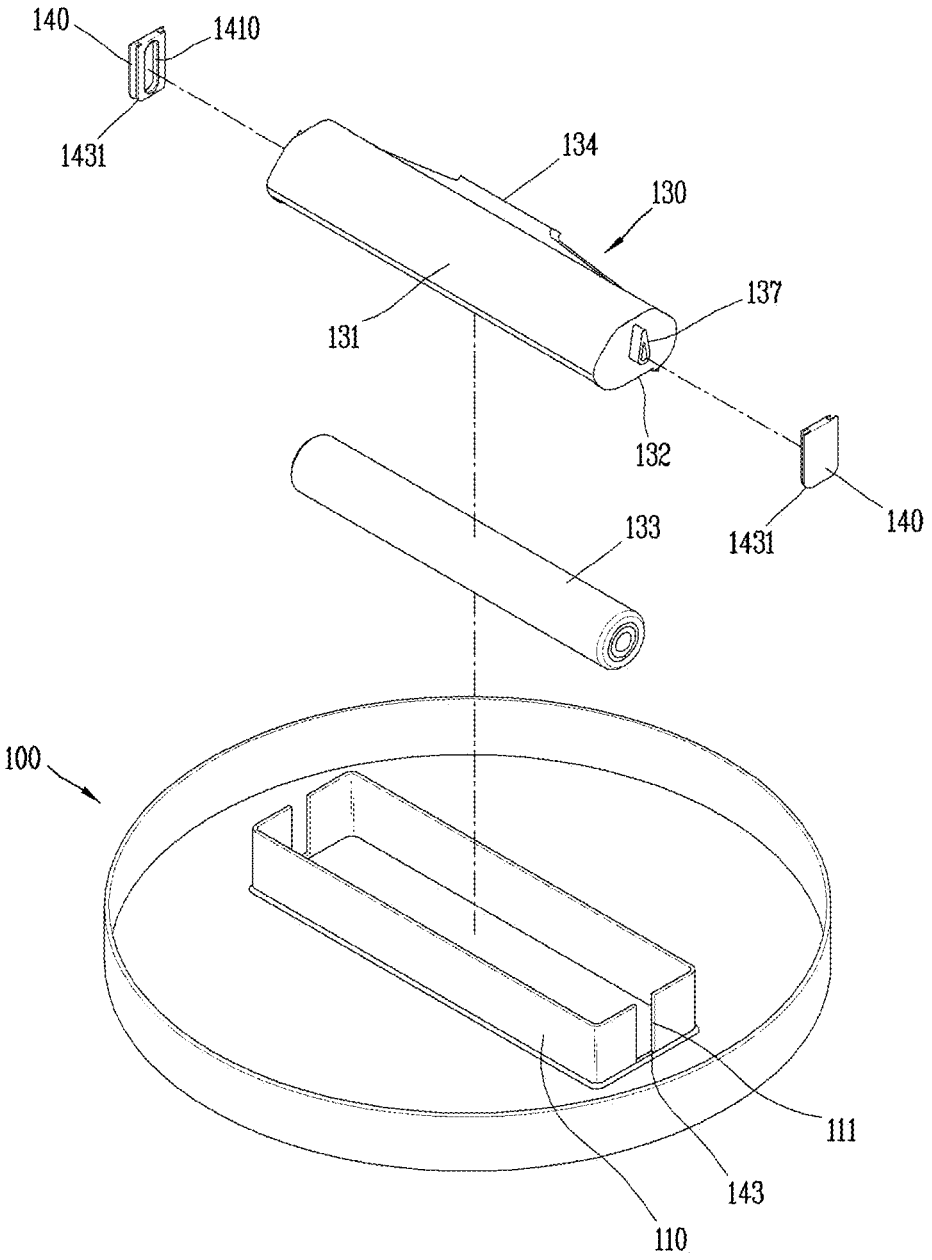
FIG. 3 is an exploded view showing a state in which the suction nozzle is disassembled from the cleaner body of FIG. 1.
Figure 4:
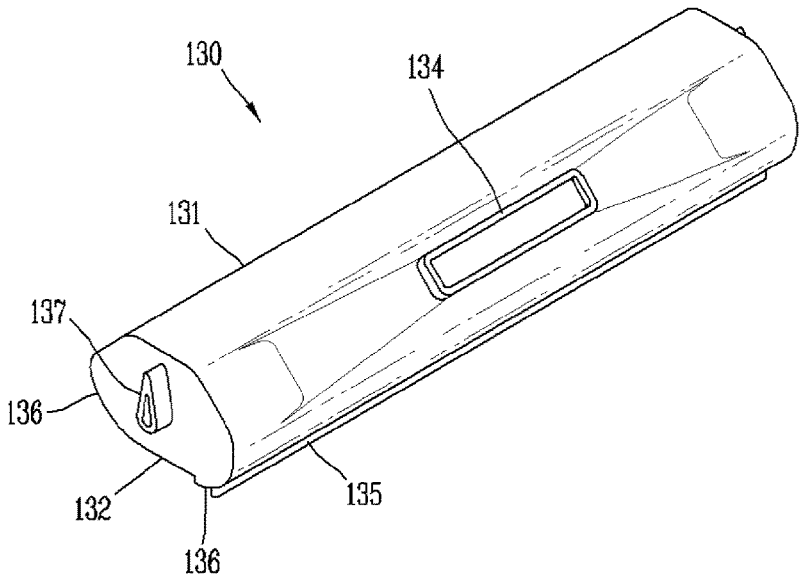
FIG. 4 is a perspective view showing a state in which the suction nozzle of FIG. 1 is viewed from a rear side.
Figure 5:
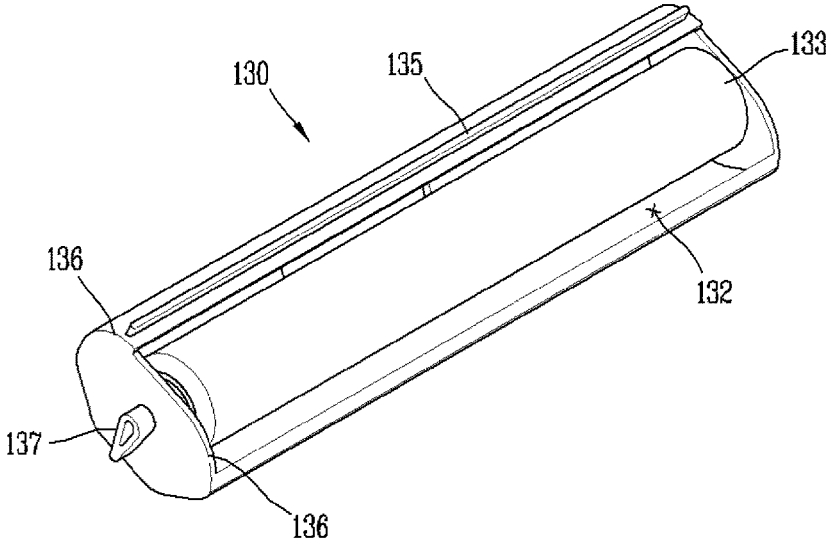
FIG. 5 is a bottom perspective view showing a state in which the suction nozzle of FIG. 4 is viewed from a bottom side.
Figure 6:
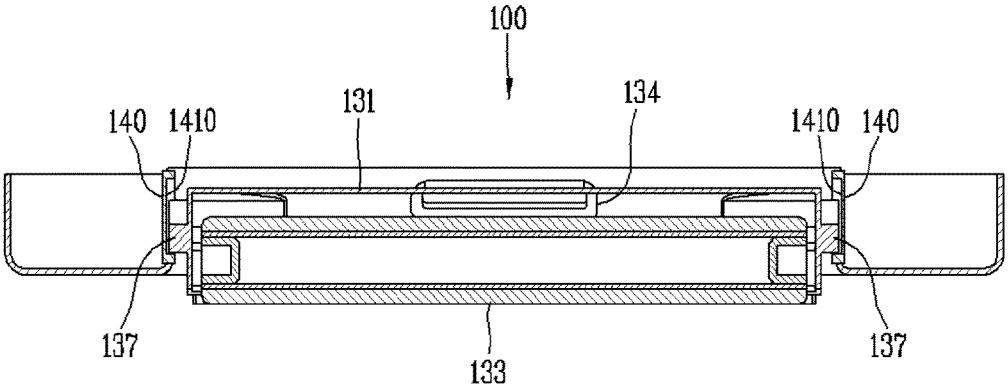
FIG. 6 is a cross-sectional view taken along line VI-VI in FIG. 1.
Figure 7:
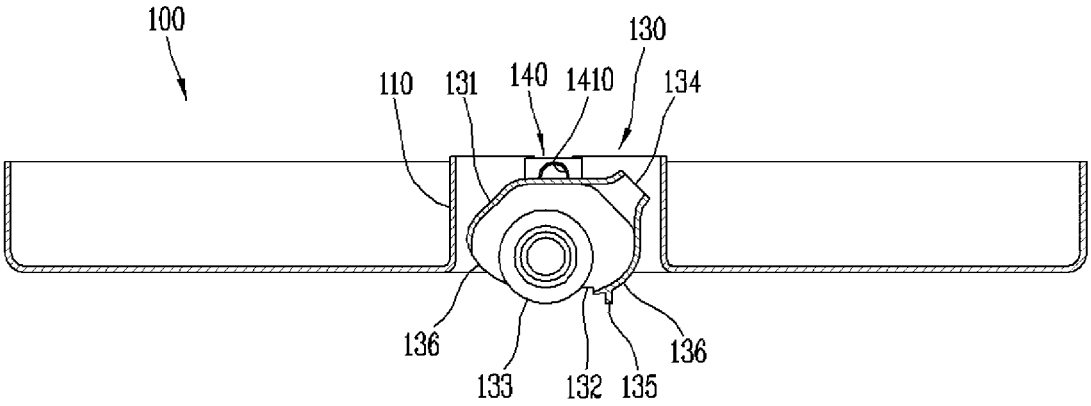
FIG. 7 is a cross-sectional view taken along line VII-VII in FIG. 1.

FIG. 3 is an exploded view showing a state in which the suction nozzle 130 is disassembled from the cleaner body 100 of FIG. 1. FIG. 4 is a perspective view showing a state in which the suction nozzle 130 of FIG. 1 is viewed from a rear side. FIG. 5 is a bottom perspective view showing a state in which the suction nozzle 130 of FIG. 4 is viewed from a bottom side. FIG. 6 is a cross-sectional view taken along line VI-VI in FIG. 1. FIG. 7 is a cross-sectional view taken along line VII-VII in FIG. 1.

Figure 8:
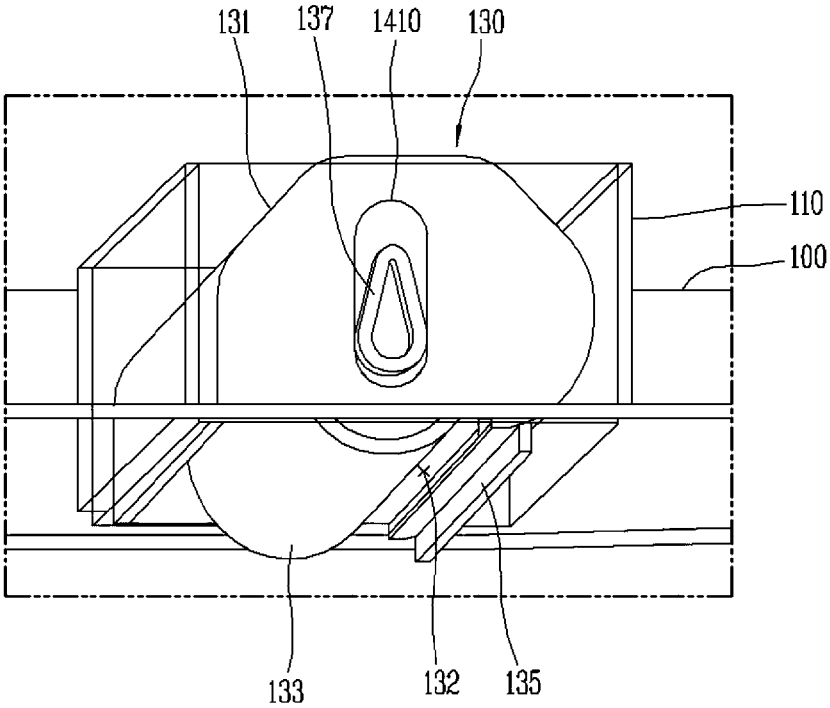
FIG. 8 is a conceptual view showing a state in which the suction nozzle is accommodated in a protruding portion.
Figure 9:
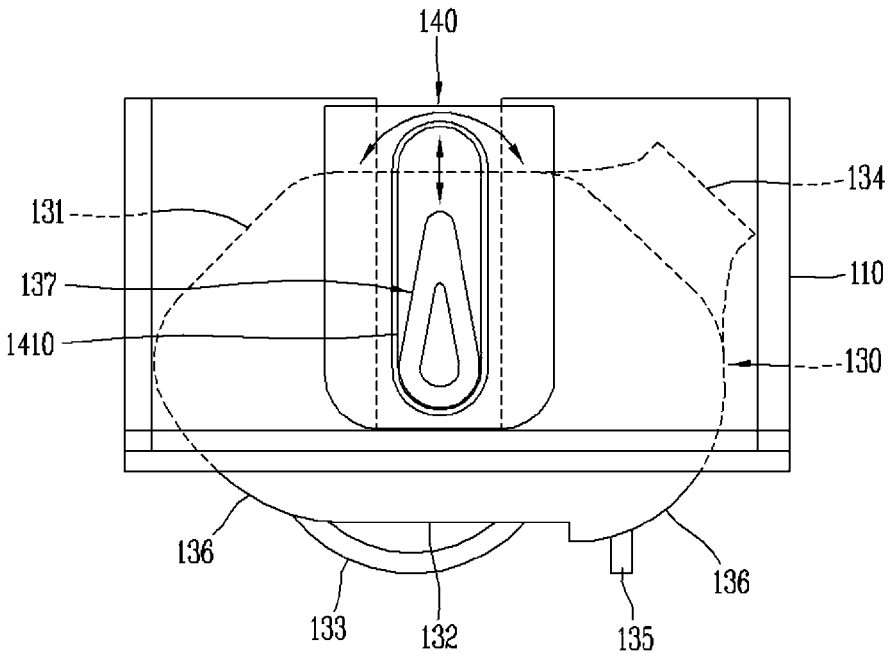
FIG. 9 is a side view of FIG. 8.
Figure 10:
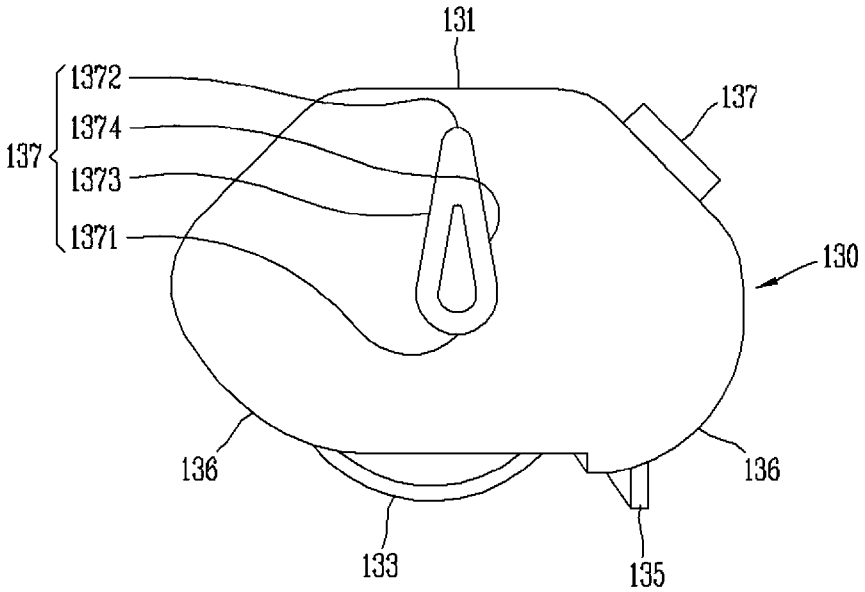
FIG. 10 is a side view showing a state in which a guide protrusion is disposed at a sidewall of the suction nozzle after a cleaner body is removed in FIG. 9.
Figure 11:
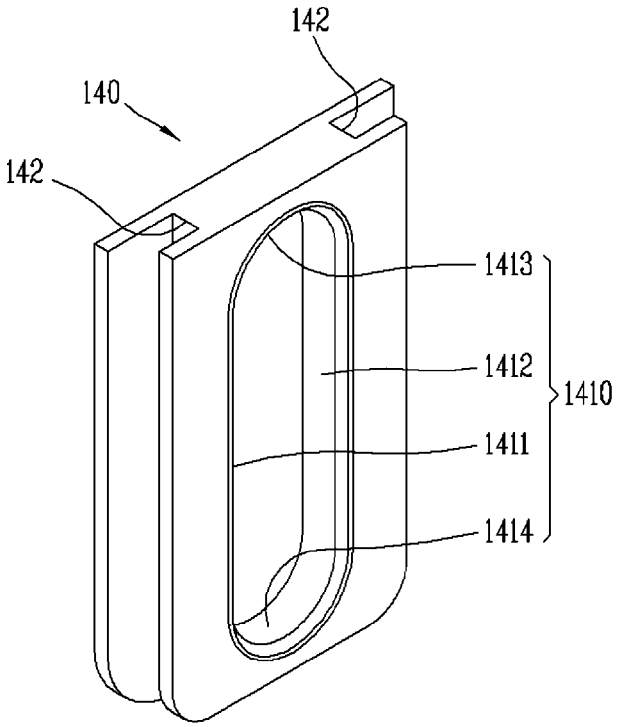
FIG. 11 is a perspective view showing a guide holder of FIG. 3.
Figure 12:
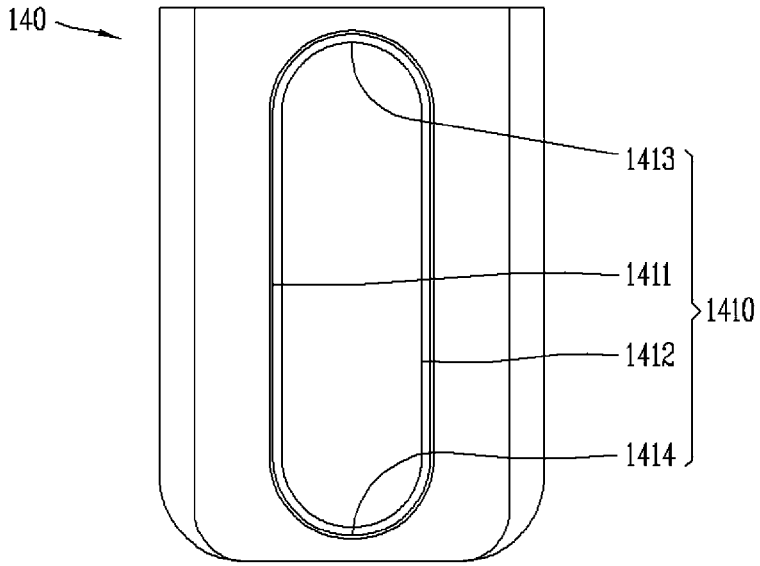
FIG. 12 is a conceptual view showing a state in which the guide holder of FIG. 11 is viewed in a lateral direction.

FIG. 8 is a conceptual view showing a state in which the suction nozzle 130 is accommodated in the protruding portion 110. FIG. 9 is a side view of FIG. 8. FIG. 10 is a side view showing a state in which a guide protrusion 137 is disposed at a sidewall of the suction nozzle 130 after the cleaner body 100 is removed in FIG. 9. FIG. 11 is a perspective view showing a guide holder 140 of FIG. 3. FIG. 12 is a conceptual view showing a state in which the guide holder 140 of FIG. 11 is viewed in a lateral direction.

The suction nozzle 130 is configured to suck foreign substances on a floor on a driving path to the inside.

To this end, the suction nozzle 130 includes a nozzle body 131, a suction port 132, an agitator 133, and a passage connection portion 134.

The nozzle body 131 extends long in left and right lateral directions of the cleaner body 100 so as to be accommodated inside the protruding portion 110. The nozzle body 131 has an accommodation space therein.

The suction port 132 is disposed on a bottom surface of the nozzle body 131. The suction port 132 is disposed inside the communication hole, and configured to communicate with the floor on the driving path. The suction port 132 is configured to suck foreign substances and air on the floor on the driving path into the nozzle body 131.

The agitator 133 is rotatably mounted on the suction port 132 of the nozzle body 131. Shaft support grooves may be concavely disposed at both end portions of the agitator 133. A rotation shaft may be disposed to protrude from each of inner surfaces of both sidewalls of the nozzle body 131. The rotation shaft is accommodated in the shaft support grooves, and the agitator 133 is rotatably mounted inside both sidewalls of the nozzle body 131.

The agitator 133 may be configured to rotate by a separate motor for the agitator 133.

The agitator 133 is defined in a cylindrical shape having a length thereof larger than a diameter thereof. A plurality of blades may be disposed in a spiral direction on an outer circumferential surface of the agitator 133. The plurality of blades may be disposed to be spaced apart from one another in a circumferential direction.

As an agitator 133 rotates, a plurality of blades are configured to brush off foreign substances accumulated on the floor or adhered to the floor while at the same time sweeping up the foreign substances with the suction port 132. A brush may be further provided between the plurality of blades. The brush can brush off foreign substances attached to the floor or sweep up the foreign substances with the suction port 132.

The auxiliary brush 135 may be provided at a rear side of the suction port 132 of the suction nozzle 130. The auxiliary brush 135 is vertically disposed in a top-down direction to brush off foreign substances on the floor or sweep up the foreign substances in a driving direction.

The passage connection portion 134 is disposed at a rear upper portion of the suction nozzle 130 to transfer foreign substances in the suctioned air to a dust collector. The passage connection portion 134 may constitute a passage outlet of the suction nozzle 130.

The passage connection portion 134 is connected to communicate with the accommodation space of the nozzle body 131. The passage connection portion 134 may be disposed to have a smaller area from an upper rear portion of the nozzle body 131 toward the passage outlet.

As the area of the passage connection portion 134 gradually decreases toward the passage outlet, a flow rate of intake air containing foreign substances may be gradually increased.

The suction nozzle 130 is in close contact with the floor surface to allow foreign substances on the floor on the driving path to be quickly sucked into the accommodation space of the nozzle body 131.

The suction nozzle 130 may be connected to communicate with a suction fan for air suction through the passage connection portion 134 to form a suction pressure of air. The suction fan may be connected to the suction motor to rotate by the suction motor.

The dust collector is mounted inside the cleaner body 100. The dust collector is connected to communicate with the suction nozzle 130 to collect foreign substances in the air sucked through the suction nozzle 130.

The suction nozzle 130 may minimize a stuck phenomenon occurring due to a height difference in the floor according to a change in the environment of the floor during driving.

To this end, the suction nozzle 130 is mounted to be ascendable/descendable with respect to the cleaner body 100. The suction nozzle 130 is freely ascendable/descendable according to a change in a height of the floor.

The suction nozzle 130 of the present disclosure may set an initial position with respect to a height between the floor surface and the nozzle body 131 on the basis of a hard floor such as a floor board.

Furthermore, the suction nozzle 130 is mounted to be swingable in a front-rear direction based on the driving direction. Swing denotes rotation within a preset angle range along the circumferential direction.

The suction nozzle 130 is configured to allow a varying operation or swinging operation in which the climbing angle of the suction nozzle 130 is inclined to actively operate even with a large change in a height difference of the floor surface.

The suction nozzle 130 of the present disclosure may be referred to as a floating nozzle. The floating nozzle denotes a nozzle capable of ascending/descending or swinging in a front-rear direction according to a change in the height of the floor.

The floating nozzle according to the present disclosure may be extended and applied not only to a robot cleaner but also to a cleaner that collects foreign substances in the sucked air.

To this end, the guide holder 140 may be provided on the cleaner body 100, and the guide protrusion 137 may be provided on the suction nozzle 130. The guide holder 140 of the cleaner body 100 may be a stationary body, and the guide protrusion 137 of the suction nozzle 130 may be a movable body. Due to an interaction between the guide holder 140 and the guide protrusion 137, the suction nozzle 130 may perform ascending/descending or swinging operation with respect to the cleaner body 100.

The guide holder 140 is configured to accommodate the guide protrusion 137. The guide holder 140 is configured to support the guide protrusion 137.

The guide holder 140 performs a function of guiding the ascending/descending and swinging operations of the guide protrusion 137 as well as a function of limiting a movement distance due to the ascending/descending operation of the guide protrusion 137 and a rotation angle due to the swinging operation thereof.

The guide holder 140 may be configured in a plate shape. The guide holder 140 may be detachably mounted to the suction nozzle 130. The guide holder 140 may be mounted on both sidewalls of the protruding portion 110.

Mounting portions 111 may be disposed on both sidewalls of the protruding portion 110, respectively. Each of the plurality of mounting portions 111 may be disposed to be open upward and passed therethrough in a thickness direction of the sidewalls. The mounting portion 111 configured with a structure blocked in a downward direction.

Slide grooves 142 may be disposed on both side surfaces of the guide holder 140, respectively. The slide grooves 142 may extend in a vertical direction or an inclined direction. In the present embodiment, it shows a state in which the slide grooves 142 are extended in the vertical direction.

The slide grooves 142 of the guide holder 140 may be slidably coupled to both edges of the mounting portion 111 in a top-down direction. The slide grooves 142 of the guide holder 140 may be slidably coupled thereto by descending toward an inner side of the mounting portion 111 while being fitted to both edges of the mounting portion 111.

The guide holder 140 may be slidably coupled to the mounting portion 111 of the protruding portion 110 to be detachably mounted on the cleaner body 100.

A plurality of round portions 1431 or inclined portions may be disposed at a lower end portion of the guide holder 140. In the present embodiment, it shows a state in which the round portion 1431 disposed at a lower end portion of the guide holder 140. The round portion 1431 denotes that it is defined in a round arc shape.

The plurality of round portions 143 or inclined portions may be disposed at a lower end portion of the mounting portion 111. The lower end portion of the mounting portion 111 may be disposed to correspond to the lower end portion of the guide holder 140. The guide holder 140 and the mounting portion 111 may be coupled in a female-male engagement.

According to this, the lower end portion of the guide holder 140 may easily enter into an upper portion of the mounting portion 111 to improve assemblability.

The guide holder 140 has a guide groove 1410 therein-side. The guide groove 1410 is configured to accommodate the guide protrusion 137. The guide groove 1410 has a larger size (or area) than the guide protrusion 137.

The guide groove 1410 is concavely disposed on one surface of the guide holder 140 in a direction facing the guide protrusion 137.

The guide groove 1410 is configured to guide an ascending/descending operation and a front-rear swinging operation of the guide protrusion 137. The guide groove 1410 is configured to limit an ascending/descending distance and a swing angle of the guide protrusion 137.

A length of the guide groove 1410 may extend long in a top-down direction.

The guide groove 1410 may include a plurality of first guide surfaces 1411, 1412 and a plurality of second guide surfaces 1413, 1414.

The plurality of first guide surfaces 1411, 1412 includes a front first guide surface 1411 disposed to face a front surface of the guide protrusion 137 and a rear first guide surface 1412 disposed to face a rear surface of the guide protrusion 137. Each of the front first guide surface 1411 and the rear first guide surface 1412 may extend in a vertical direction.

The front first guide surface 1411 may be brought into contact with one of both side surfaces in a front-rear direction of the guide protrusion 137 to limit a front-rear rotation angle (swing angle) of the guide protrusion 137.

The plurality of second guide surfaces 1413, 1414 includes an upper second guide surface 1413 and a lower second guide surface 1414.

The upper second guide surface 1413 is configured to connect upper ends of the front first guide surface 1411 and the rear first guide surface 1412, respectively.

The lower second guide surface 1414 is configured to connect lower ends of the front first guide surface 1411 and the rear first guide surface 1412, respectively.

Each of the plurality of second guide surfaces 1413, 1414 may be disposed in a curved shape having a preset curvature. For example, each of the plurality of second guide surfaces 1413, 1414 may be disposed in a semicircular curved shape.

The upper second guide surface 1413 may be convexly disposed in an upward direction, and the lower second guide surface 1414 may be convexly disposed in a downward direction.

The upper second guide surface 1413 may be disposed to face an upper surface of the guide protrusion 137 to be brought into contact with each other. The lower second guide surface 1414 may be disposed to face a lower surface of the guide protrusion 137 to be brought into contact with each other.

Each of the plurality of second guide surfaces 1413, 1414 may limit a top-down movement distance of the guide protrusion 137.

The guide protrusion 137 is disposed to protrude from both sidewalls of the nozzle body 131 in a length direction of the nozzle body 131 toward the guide groove 1410.

The guide protrusion 137 may include a lower curved surface 1371, an upper curved surface 1372, and an inclined surface.

The lower curved surface 1371 may have a curvature corresponding to that of the lower second guide surface 1414.

The lower curved surface 1371 may have a diameter similar to that of the lower second guide surface 1414 and may be defined in an arc shape. The lower second guide surface 1414 is configured to surround the lower curved surface 1371. The lower curved surface 1371 may rotatably come into contact with the lower second guide surface 1414 therealong.

The lower curved surface 1371 may be rotatably fitted to the lower second guide surface 1414.

The lower curved surface 1371 is configured to slidably rotate along a circumferential direction on the lower second guide surface 1414.

The upper curved surface 1372 may be defined in an arc shape having a diameter smaller than an arc of the lower curved surface 1371. The upper curved surface 1372 may be disposed to have a diameter smaller than a width of the guide groove 1410. The upper curved surface 1372 is disposed to be spaced apart from a first guide surface of the guide groove 1410 in a front-rear direction.

A height between the upper curved surface 1372 and the lower curved surface 1371 is smaller than a distance between the upper second guide surface 1413 and the lower second guide surface 1414 of the guide groove 1410. The upper curved surface 1372 is disposed to face in a top-down direction so as to be brought into contact with the upper second guide surface 1413, and the lower curved surface 1371 is disposed to face in a top-down direction so as to be brought into contact with the lower second guide surface 1414.

Each of the plurality of inclined surfaces 1373, 1374 is inclined to connect one end of each of the lower curved surface 1371 and the upper curved surface 1372 to each other. The plurality of inclined surfaces 1373, 1374 include a front inclined surface 1373 and a rear inclined surface 1374. The front inclined surface 1373 is disposed in a direction to face the front first guide surface 1411, and the rear inclined surface 1374 is disposed in a direction to face the rear first guide surface 1412.

The front inclined surface 1373 is disposed to be inclined upward from a front side to a rear side with respect to a vertical line passing through the centers of the upper curved surface 1372 and the lower curved surface 1371, and the rear inclined surface 1374 is disposed to be inclined downward from a front side to a rear side with respect to the vertical line.

An inclination angle of each of the front inclined surface 1373 and the rear inclined surface 1374 determines a swing (rotation) angle of the guide protrusion 137.

The inclination angle of each of the front inclined surface 1373 and the rear inclined surface 1374 may be the same as or different from each other. In this embodiment, each of the front inclined surface 1373 and the rear inclined surface 1374 has the same inclination angle and shows a symmetrical shape.

As the inclination angle of the front inclined surface 1373 increases, a downward inclination angle of the nozzle body 131 increases with respect to a horizontal bottom surface of the cleaner body 100. As the inclination angle of the rear inclined surface 1374 increases, a climbing (upward inclination) angle of the nozzle body 131 increases with respect to the horizontal bottom surface of the cleaner body 100.

A round portion 136 or a tapered portion may be disposed at a lower front end portion and a lower rear end portion of the suction nozzle 130, respectively. In this embodiment, it shows a state in which the round portion 136 is disposed at the lower front end portion and the lower rear end portion of the suction nozzle 130, respectively.

Assuming that the sidewall of the suction nozzle 130 is rectangular, the round portion 136 is located at a front lower corner connecting a front edge and a lower edge thereof. Furthermore, the round portion 136 is located at a rear lower corner connecting a rear edge and a lower edge thereof.

According to this configuration, the round portion 136 or the tapered portion may obtain an effect of reducing a stuck phenomenon of the suction nozzle 130 according to a change in the height of the floor surface or when encountering an obstacle when moving forward or backward on the floor surface on the driving path.

A buffer member may be provided between the guide groove 1410 and the guide protrusion 137. For example, the buffer member may be disposed to extend along an outer surface of the guide protrusion 137, thereby alleviating an impact and noise generated by a collision with the guide groove 1410 during the ascending/descending and swinging operation of the guide protrusion 137.

Figure 13A:
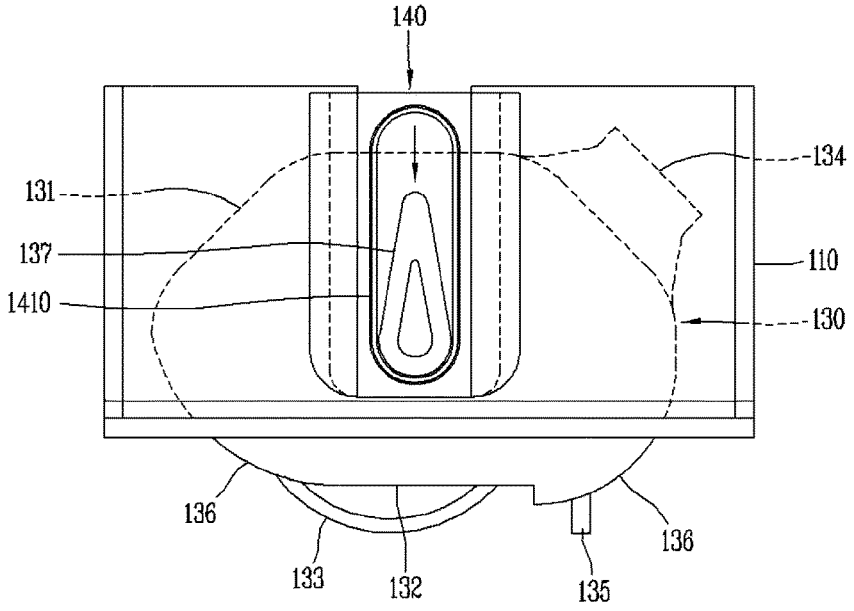
FIGS. 13A and 13B are operational state views showing a state in which the suction nozzle ascends/descends with respect to the cleaner body in FIG. 9.
Figure 13B:
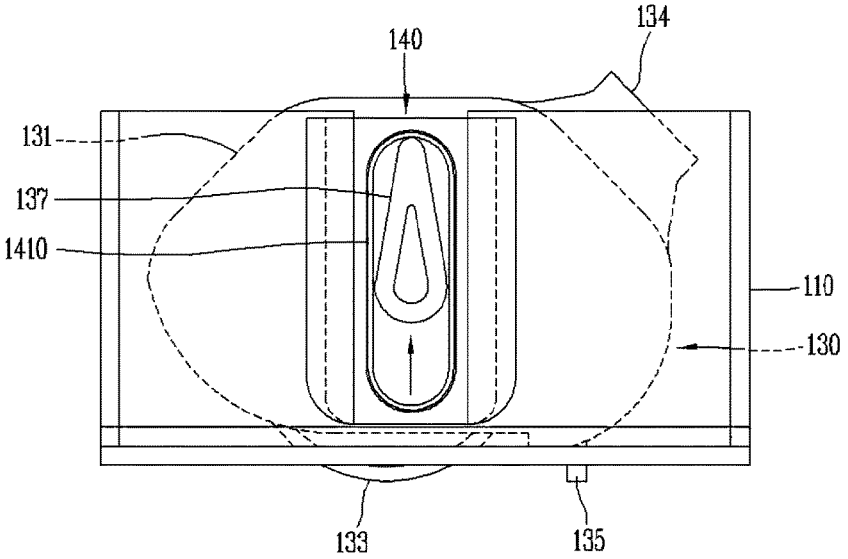

FIGS. 13A and 13B are operational state views showing a state in which the suction nozzle 130 ascends/descends with respect to the cleaner body 100 in FIG. 9.

The guide protrusion 137 of the present disclosure may be accommodated in the guide groove 1410 concavely disposed on one surface of the guide holder 140, or may be accommodated in the guide hole 1510 disposed to pass through both sidewalls of the protruding portion 110. FIGS. 13A and 13B show a state in which the guide protrusion 137 is accommodated in the guide hole 1510 disposed at both sidewalls of the protruding portion 110.

FIG. 13A shows a state in which the suction nozzle 130 descends with respect to the cleaner body 100, and FIG. 13B shows a state in which the suction nozzle 130 ascends with respect to the cleaner body 100.

A diameter of the lower curved surface 1371 of the guide protrusion 137 may correspond to a width of the guide groove 1410, and the guide groove 1410 may extend in a vertical direction. The guide groove 1410 may stably guide an ascending/descending operation of the guide protrusion 137 in a front-rear direction without shaking.

According to this configuration, as the guide protrusion 137 ascends along the guide groove 1410, the robot cleaner ascends/descends according to a change in the height of the floor on the driving path. Accordingly, the robot cleaner may minimize a stuck phenomenon occurring due to a change in the height of the floor environment.

Figure 14A:
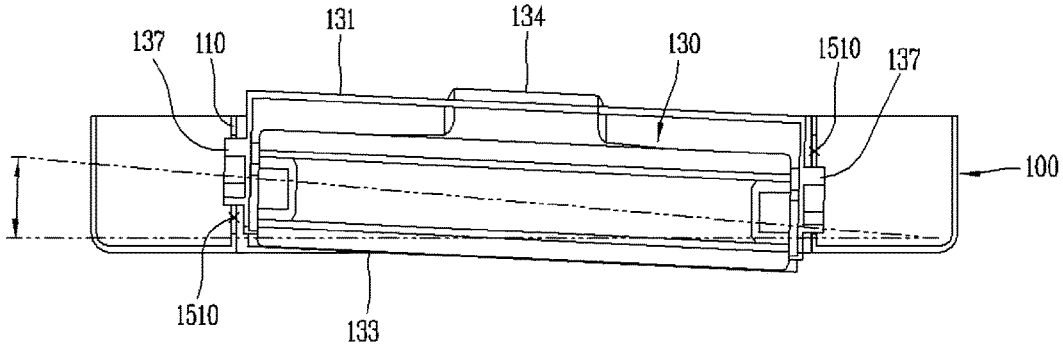
FIGS. 14A and 14B are operational state views showing a state in which the suction nozzle partially ascends/descends respect to the cleaner body in FIG. 6.
Figure 14B:
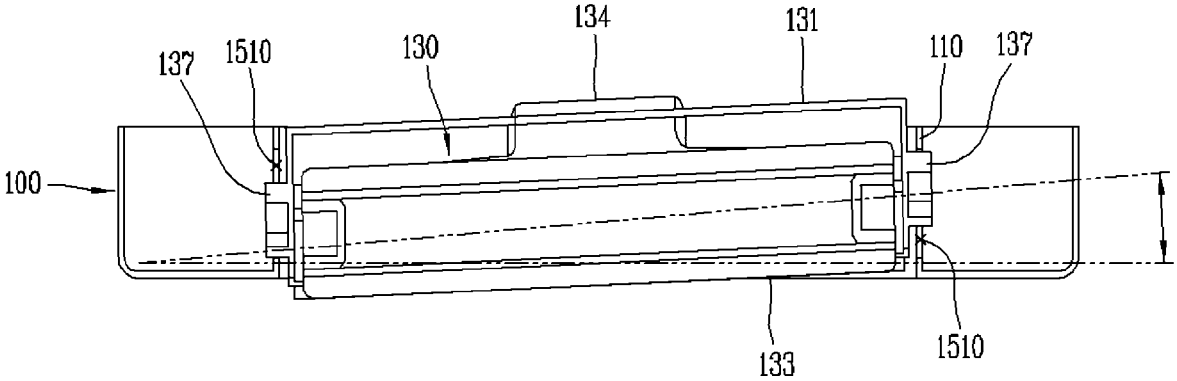

FIGS. 14A and 14B are operational state views showing a state in which the suction nozzle 130 partially ascends/descends with respect to the cleaner body 100 in FIG. 6.

FIG. 14A shows a state in which a left end portion of the suction nozzle 130 ascends and a right end portion of the suction nozzle 130 descends.

FIG. 14B shows a state in which the right end portion of the suction nozzle 130 ascends and the left end portion of the suction nozzle 130 descends.

For example, when an obstacle is located at a left side of the suction nozzle 130 and there is no obstacle at a right side of the suction nozzle 130, as illustrated in FIG. 14A, the left end portion of the suction nozzle 130 may ascend, and the right end portion of suction nozzle 130 may descend.

On the contrary, when an obstacle is located at a right side of the suction nozzle 130 and there is no obstacle at a left side of the suction nozzle 130, as illustrated in FIG. 14B, the right end portion of the suction nozzle 130 may ascend, and the left end portion of the suction nozzle 130 may descend.

Figure 15A:
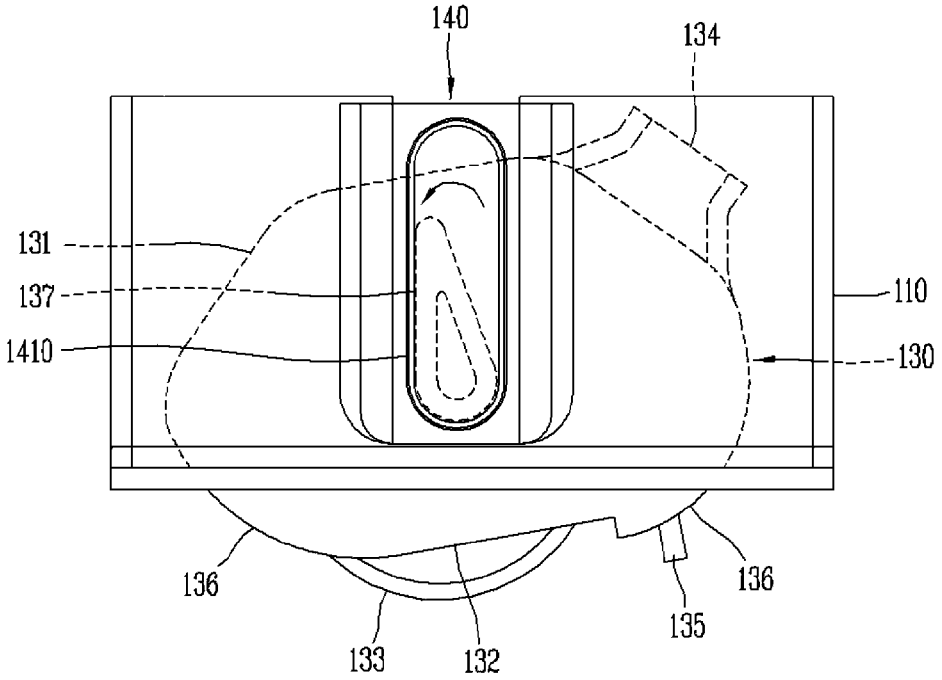
FIGS. 15A and 15B are operational state views showing a state in which the suction nozzle swings in a front-rear direction with respect to the cleaner body in FIG. 9.
Figure 15B:
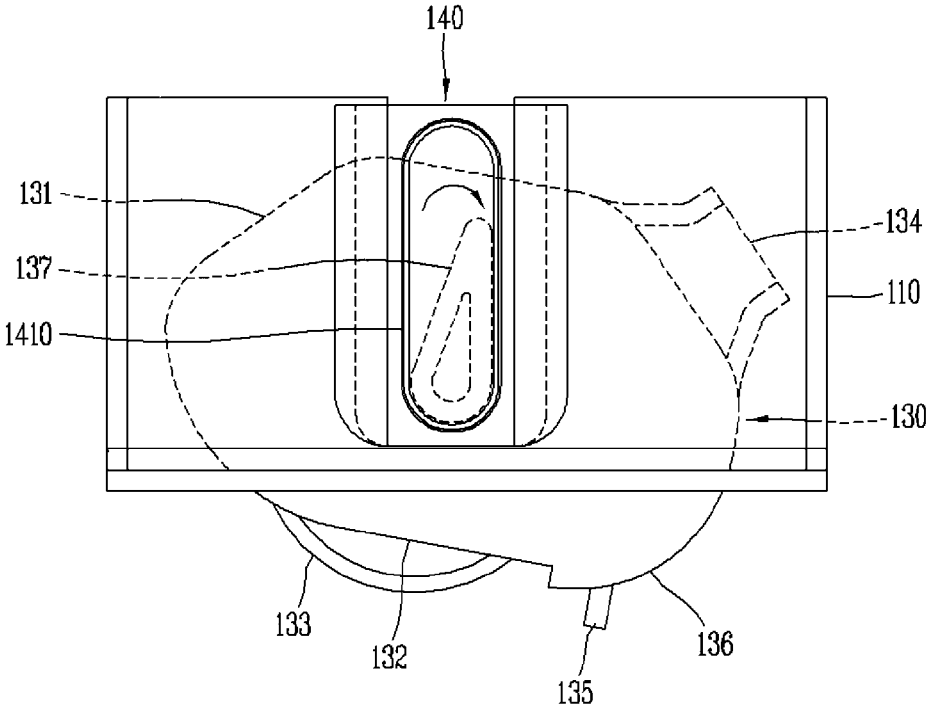

FIGS. 15A and 15B are operational state views showing a state in which the suction nozzle 130 swings in a front-rear direction respect to the cleaner body 100 in FIG. 9.

FIG. 15A shows a state in which as the upper curved surface 1372 of the guide protrusion 137 rotates forward around the lower curved surface 1371, the suction nozzle 130 rotates in a forward direction, and a front end portion of the nozzle body 131 is inclined in a downward direction. FIG. 15A shows, for example, a state in which the suction nozzle 130 rotates in a downwardly inclined manner in a forward direction with respect to the cleaner body 100 when the floor surface of the driving path of the robot cleaner is inclined downward or a height of the floor surface moves from a high place to a low place.

FIG. 15B shows a state in which as the upper curved surface 1372 of the guide protrusion 137 rotates backward around the lower curved surface 1371, the suction nozzle 130 rotates in a rear direction and the front end portion of the nozzle body 131 is lifted in an upward direction. FIG. 15B shows, for example, a state in which the suction nozzle 130 rotates in an upwardly inclined manner in a backward direction with respect to the cleaner body 100 when the floor surface of the driving path of the robot cleaner is inclined upward or the height of the floor surface moves from a low place to a high place.

According to this configuration, the front or rear end portion of the nozzle body 131 may be inclined downward or lifted in an upward direction with respect to the bottom surface of the cleaner body 100 or lifted upward according to a change in the height of the floor surface to vary a climbing angle of the suction nozzle 130 so as to actively operate even with a large change in a height difference of the floor surface, thereby further improving driving performance.

To incline the suction nozzle 130 upward (to rotate the suction nozzle 130 in a backward direction) may allow the front end portion of the suction nozzle 130 to be lifted than the rear end portion thereof when moving from a low place to a high place while moving forward on the floor surface on the driving path, thereby eliminating a stuck phenomenon as well as varying the climbing angle while moving forward to further improve driving performance.

To incline the suction nozzle 130 downward (to rotate the suction nozzle 130 in a forward direction) may allow the rear end portion of the suction nozzle 130 to be lifted than the front end portion thereof when moving from a low place to a high place while moving backward on the floor surface on the driving path, thereby eliminating a stuck phenomenon as well as varying the climbing angle while moving backward to further improve driving performance.

Figure 16:
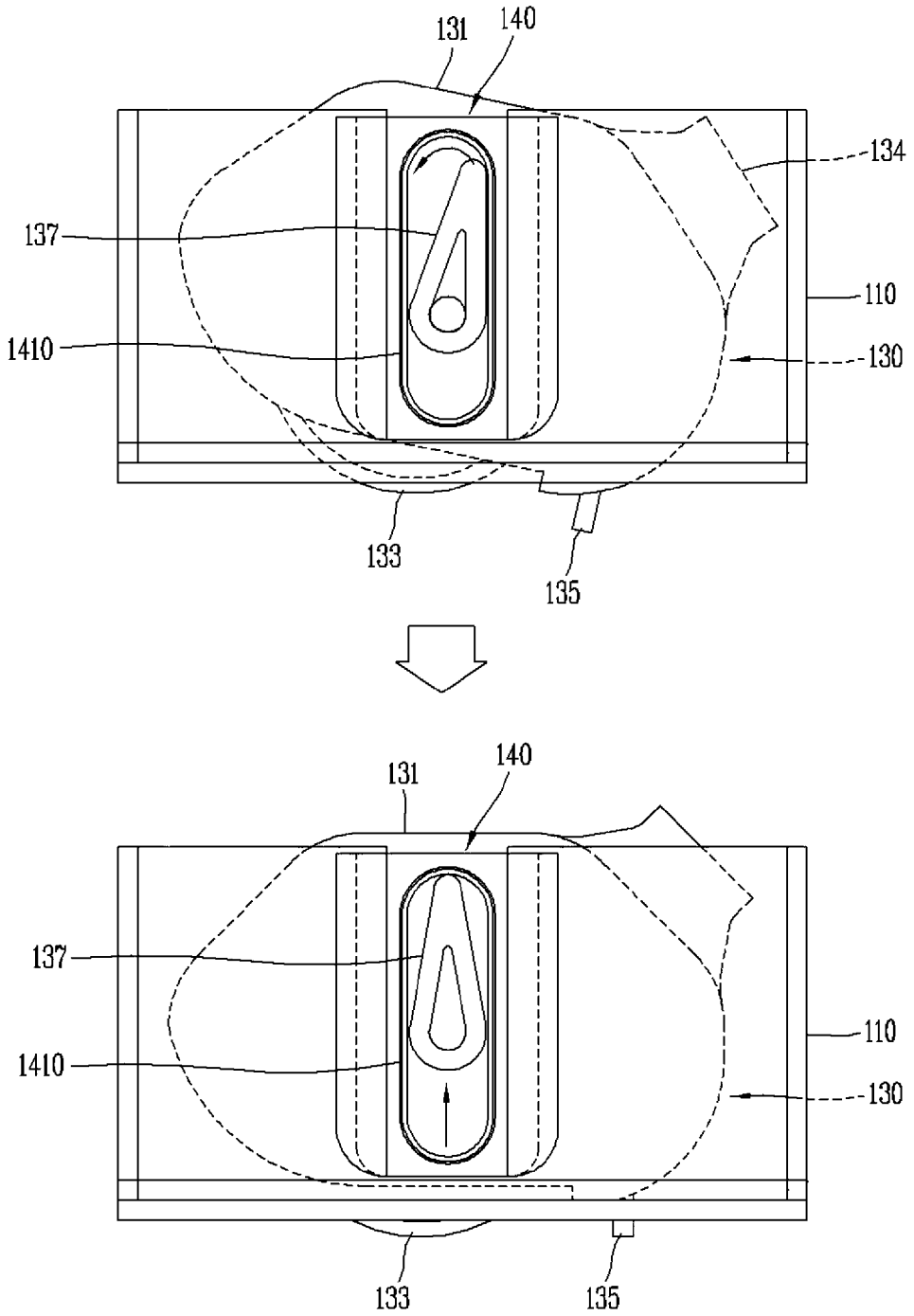
FIG. 16 is an operation state view for explaining an effect of horizontally corrected when the guide protrusion rotated in a rear direction in FIG. 15B ascends.

FIG. 16 is an operation state view for explaining an effect of horizontally corrected when the guide protrusion rotated in a rear direction in FIG. 15B ascends.

An upper drawing of FIG. 16 shows a state in which the suction nozzle 130 ascends while the suction nozzle 130 rotates in a rearward direction with respect to the cleaner body 100.

When the upper curved surface 1372 of the guide protrusion 137 further ascends from an upper end of the rear first guide surface 1412, it passes a right end of the upper second guide surface 1413 to rotate toward the top peak of the upper second guide surface 1413.

A center line passing through the center of curvature of the upper curved surface 1372 of the guide protrusion 137 and the center of curvature of the lower curved surface 1371 may coincide with a vertical center line of the guide groove 1410 at the top peak of the upper second guide surface 1413.

According to this configuration, when the guide protrusion 137 ascends to the top peak of the guide groove 1410 in a swinging state, the nozzle body 131 may be change from an inclined state to a horizontal state, thereby maintaining a surface pressure of the suction nozzle 130 and increasing a suction pressure thereof. The swinging operation of the suction nozzle 130 may change the climbing angle to improve driving performance, but decrease the suction performance of the suction nozzle 130.

Accordingly, when the guide protrusion 137 ascends to the top peak of the guide groove 1410, a correction from the inclined state of the suction nozzle 130 to the horizontal state thereof may improve the suction performance of the suction nozzle 130.

Figure 17:
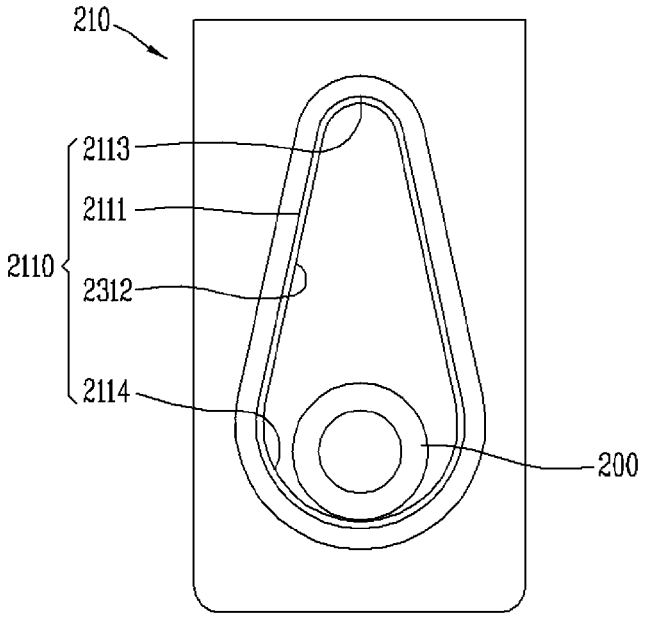
FIG. 17 is a conceptual view showing a modified example of a guide protrusion and a guide holder according to another embodiment of the present disclosure.

FIG. 17 is a conceptual view showing a modified example of a guide protrusion 200 and a guide holder 210 according to another embodiment of the present disclosure.

In this embodiment, the guide protrusion 200 is defined in a circular shape, and a guide groove 2110 is similar to a shape of a water droplet falling from the sky in the direction of gravity. The guide protrusion 200 may be provided in the suction nozzle 130, and the guide groove 2110 may be provided in the cleaner body 100.

The guide groove 2110 includes a front first guide surface 2111, a rear first guide surface 2112, an upper second guide surface 2113, and a lower second guide surface 2114.

The front first guide surface 2111 is disposed to be inclined upward from a front side to a rear side so as to connect left end portions of the upper second guide surface 2113 and the lower second guide surface 2114, respectively.

The rear first guide surface 2112 is disposed to be inclined downward from a front side to a rear so as to connect right end portions of the upper second guide surface 2113 and the lower second guide surface 2114, respectively.

The front first guide surface 2111 and the rear first guide surface 2112 may be defined to be symmetrical to each other.

The upper second guide surface 2113 and the lower second guide surface 2114 may be defined in a semicircular arc shape. The upper second guide surface 2113 has a smaller radius of curvature than the lower second guide surface 2114. A diameter of the upper second guide surface 2113 is smaller than that of the lower second guide surface 2114.

The guide protrusion 200 in a circular shape may be disposed to protrude from both sidewalls of the suction nozzle 130 toward the guide groove 2110 of the guide holder 210.

A diameter of the guide protrusion 200 is smaller than that of the lower second guide surface 2114.

The guide protrusion 200 in a circular shape may be accommodated in the guide groove 2110 and mounted so as to ascend/descend or swing in a front-rear direction.

According to this configuration, as the guide protrusion 200 ascends or descends along the guide groove 2110 or rotates in a front-rear direction, the suction nozzle 130 may perform an ascending/descending operation and a swinging operation with respect to the cleaner body 100.

For example, when the robot cleaner drives along an upward slope or from a low place to a high place on the floor surface on the driving path, the guide protrusion 200 may rotationally move backward along the lower second guide surface 2114 of the guide groove 2110. The guide protrusion 200 rotates in a clockwise direction.

When the guide protrusion 200 rotates clockwise, the front end portion of the suction nozzle 130 is inclined upward in a driving direction while ascending than the rear end portion thereof.

For example, when the robot cleaner drives along a downward slope or from a high place to a low place on the floor surface on the driving path, the guide protrusion 200 may rotationally move forward along the lower second guide surface 2114 of the guide groove 2110. The guide protrusion 200 rotates in a counterclockwise direction.

When the guide protrusion 200 rotates in a counterclockwise direction, the rear end portion of the suction nozzle 130 is inclined downward toward the driving direction while ascending than the front end portion thereof.

The other configurations are the same as or similar to those of the above-described embodiment, redundant description will be omitted.

Figure 18:
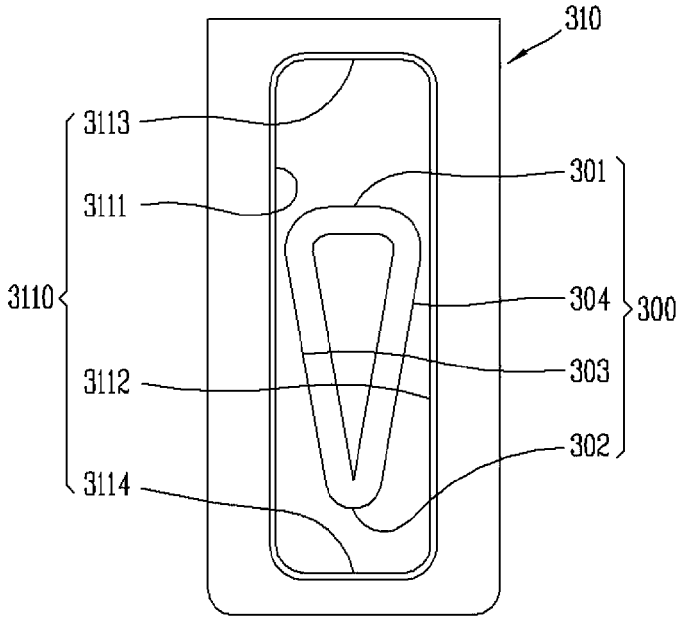
FIG. 18 is a conceptual view showing a modified example of a guide protrusion and a guide holder according to still another embodiment of the present disclosure.

FIG. 18 is a conceptual view showing a modified example of a guide protrusion 300 and a guide holder 310 according to still another embodiment of the present disclosure.

In this embodiment, it shows a state in which the guide protrusion 300 is defined in an inverted triangle, and the guide groove 3110 is defined in a rectangular shape whose a vertical length is larger than a horizontal length thereof. The guide protrusion 300 may be provided in the suction nozzle 130, and the guide groove 3110 may be provided in the cleaner body 100.

The guide groove 3110 includes a front first guide surface 3111, a rear first guide surface 3112, an upper second guide surface 3113, and a lower second guide surface 3114.

The front first guide surface 3111 extends vertically so as to connect left end portions of the upper second guide surface 3113 and the lower second guide surface 3114, respectively.

The rear first guide surface 3112 extends vertically so as to connect right end portions of the upper second guide surface 3113 and the lower second guide surface 3114, respectively.

The front first guide surface 3111 and the rear first guide surface 3112 may be defined to be symmetrical to each other.

Each of the upper second guide surface 3113 and the lower second guide surface 3114 may be disposed horizontally. A corner of each of the front and rear first guide surfaces 3112 and the upper and lower second guide surfaces 3114 may be disposed in a rounded manner.

The guide protrusion 300 may be defined in an inverted triangle, and each corner of the inverted triangle may be disposed in a rounded manner.

The guide protrusion 300 includes an upper flat portion 301, a lower curved portion 302, a front inclined surface 303, and a rear inclined surface 304.

A length of the upper flat portion 301 is larger than a diameter of the lower curved portion 302.

The front inclined surface 303 is inclined to connect left end portions of the upper flat portion 301 and the lower curved portion 302. The front inclined surface 303 is disposed to be inclined downward from a front side to a rear side.

The rear inclined surface 304 is inclined to connect right end portions of the upper flat portion 301 and the lower curved portion 302. The rear inclined surface 304 is disposed to be inclined upward from a front side to a rear side.

The guide protrusion 300 in an inverted triangular shape may be accommodated in the guide groove 3110 and mounted so as to ascend/descend or swing in a front-rear direction.

According to this configuration, as the guide protrusion 300 ascends or descends along the guide groove 3110 or rotates in a front-rear direction, the suction nozzle 130 may perform an ascending/descending operation and a front-rear swinging operation with respect to case cleaner body 100.

For example, when the robot cleaner drives along an upward slope or from a low place to a high place on the floor surface on the driving path, the lower curved portion 302 of the guide protrusion 300 may rotate forward around the center of gravity of an inverted triangle.

The front inclined surface 303 of the guide protrusion 300 may be brought into contact with the front first guide surface 3111 of the guide groove 3110.

When the guide protrusion 300 rotates clockwise, the front end portion of the suction nozzle 130 is inclined upward in a driving direction while ascending than the rear end portion thereof.

On the contrary, when the robot cleaner drives along a downward slope or from a high place to a low place on the floor surface on the driving path, the lower curved portion 302 of the guide protrusion 300 may rotate backward around the center of gravity of an inverted triangle.

The rear inclined surface 304 of the guide protrusion 300 may be brought into contact with the rear first guide surface 3112 of the guide groove 3110.

When the guide protrusion 300 rotates in a counterclockwise direction, the rear end portion of the suction nozzle 130 is inclined downward in a driving direction while ascending than the upper end portion.

The other configurations are the same as or similar to those of the above-described embodiment, redundant description will be omitted.

Therefore, according to the present disclosure, the guide protrusion 137 may be slidably mounted in a top-down direction while being accommodated in the guide groove 1410 to allow the suction nozzle 130 to be ascendable/descendable with respect to the cleaner body 100 according to a change in the height of the floor, thereby improving driving performance.

In addition, the front and rear surfaces of the guide protrusion 137 may be disposed to be inclined with respect to the front and rear surfaces of the guide groove 1410, thereby allowing the guide protrusion 137 to be rotatable in a front-rear direction with respect to the cleaner body 100 while being accommodated in the guide groove 1410.

Therefore, the suction nozzle 130 may be swingable in a front-rear direction with respect to the cleaner body 100, so that when the robot cleaner moves forward and backward, a climbing angle of the suction nozzle 130 varies so as to be actively operated even with a large change in a height difference of the floor surface, thereby further improving driving performance.

In addition, when the guide protrusion 137 ascends to a top peak of the guide groove 1410, a circular upper curved surface 1372 of the guide protrusion 137 may rotate to the top peak along an upper second guide surface 3113 while inscribed in the upper second guide surface 3113 of the guide groove 1410 defined in a circular shape having a larger diameter.

Therefore, the suction nozzle 130 may be automatically adjusted from an inclined state to a horizontal state by rotationally moving the guide protrusion 137 in a vertical direction from a swing state of the guide protrusion 137 at the top peak of the guide groove 1410, thereby improving the suction performance and cleaning performance of the suction nozzle 130. The suction nozzle 130 maximizes the surface pressure and suction pressure when parallel to the floor surface or close to a horizontal state.

In the above-described embodiment, a structure in which the guide holder 140, 210, 310 is provided on the cleaner body 100, and the guide protrusion 137, 200 and 300 is provided on the suction nozzle 130 to allow the suction nozzle 130 to be ascendable/descendable and swingable in a front-rear direction with respect to the cleaner body 100 by an interaction between the guide holder 140, 210, 310 and the guide protrusions 137, 200, 300 has been mainly described.

Meanwhile, the guide holder may be provided on the suction nozzle 130, and the guide protrusion may be provided on the cleaner body 100. In this case, the guide holder of the suction nozzle 130 may be a movable body, and the guide protrusion of the cleaner body 100 may be a stationary body. Even in this case, an ascending/descending and a swinging operation of the suction nozzle 130 may be carried out by an interaction between the guide holder and the guide protrusion. The other components are the same as or similar to those of the above-described embodiment, redundant description will be omitted.

The invention claimed is:

1. A robot cleaner, comprising:

a cleaner body provided with a plurality of guide holders therein; and a suction nozzle provided with guide protrusions protruding from both sidewalls in a length direction toward the plurality of guide holders, respectively, to be accommodated inside the plurality of guide holders, respectively, and mounted to be ascendable/descendable and swingable in a front-rear direction with respect to the cleaner body, wherein each of the plurality of guide holders comprises a guide groove that accommodates the guide protrusion to guide the guide protrusion to perform a top-down movement and a rotational operation in a front-rear direction.

2. The robot cleaner of claim 1, having a structure in which the guide groove disposed on one side surface of each of the plurality of guide holders is open in a direction facing the guide protrusion, and the other side of each of the plurality of guide holders facing opposite to the guide groove is closed.

3. The robot cleaner of claim 1, wherein a width of the guide groove is maintained constant in a top-down direction, and a width of the guide protrusion is disposed to be narrower from a lower portion thereof to an upper portion thereof, and the lower portion of the guide protrusion is defined to have a size corresponding to that of a lower portion of the guide groove.

4. The robot cleaner of claim 1, wherein a length of the guide groove is longer in a top-down direction than a width thereof, and each of upper and lower end portions of the guide protrusion is defined in a shape corresponding to each of upper and lower end portions of the guide groove, and a width of the upper end portion of the guide protrusion is smaller than that of the upper end portion of the guide groove.

5. The robot cleaner of claim 1, wherein the guide groove comprises:

a plurality of first guide surfaces extending in parallel in a top-down direction to be brought into contact with one of both side surfaces in a front-rear direction of the guide protrusion so as to limit a front-rear rotation angle of the guide protrusion; and a plurality of second guide surfaces defined in an arc-shaped curved surface shape to connect upper and lower ends of each of the plurality of first guide surfaces to be brought into contact with one end portion of both end portions in a top-down direction of the guide protrusion so as to limit a top-down movement distance of the guide protrusion.

6. The robot cleaner of claim 1, wherein the guide protrusion comprises:

a lower curved surface disposed in an arc shape to slidably rotate along a circumferential direction at an inner side of the guide groove;

an upper curved surface disposed in an arc shape having a diameter smaller than that of an arc of the lower curved surface to rotate around the lower curved surface inside the guide groove; and a plurality of inclined surfaces connecting both ends of each of the lower curved surface and the upper curved surface.

7. The robot cleaner of claim 1, wherein the guide groove decreases in width from a lower portion to an upper portion of the guide holder, and an outer periphery of the guide protrusion that comes into contact with the guide holder is defined in a circular shape.

8. The robot cleaner of claim 1, wherein the guide groove is disposed to have a constant width from the lower portion to the upper portion of the guide holder, and the guide protrusion increases in width from the lower portion to the upper portion of the guide holder.

9. The robot cleaner of claim 1, further comprising:

a protruding portion protruding upward from a bottom surface of the cleaner body and provided with a communication hole communicating with a floor surface on a driving path at an inner side thereof, wherein slide grooves are disposed on both side surfaces of the plurality of guide holders, respectively, to allow each of the plurality of guide holders to be slidably coupled to both sidewalls of the protruding portion.

10. The robot cleaner of claim 1, having a structure in which both end portions of the suction nozzle in a length direction are independently ascendable/descendable from each other with respect to the cleaner body.

11. The robot cleaner of claim 1, wherein a tapered portion is disposed in an inclined manner or a round portion is disposed in a rounded manner at each of the front and rear end portions at a lower portion of the suction nozzle.

12. A robot cleaner, comprising:

a cleaner body provided with a plurality of guide holders therein; and a suction nozzle provided with guide protrusions protruding from both sidewalls in a length direction toward the plurality of guide holders, respectively, to be accommodated inside the plurality of guide holders, respectively, and mounted to be ascendable/descendable and swingable in a front-rear direction with respect to the cleaner body, wherein each of the plurality of guide holders is provided with a guide groove that guides the guide protrusion to perform a top-down movement and a rotational operation in a front-rear direction, wherein the guide protrusion comprises:

a lower curved surface disposed in an arc shape to slidably rotate along a circumferential direction at an inner side of the guide groove;

an upper curved surface defined in an arc shape having a diameter smaller than that of an arc of the lower curved surface, and spaced apart from the lower curved surface in an upward direction; and a plurality of inclined surfaces connecting both ends of each of the lower curved surface and the upper curved surface, and wherein during the swing of the suction nozzle, the upper curved surface rotates in a front-rear direction around the lower curved surface at an inner side of the guide groove.

13. The robot cleaner of claim 12, wherein the guide groove comprises:

a lower guide surface defined in an arc shape having a size corresponding to that of the lower curved surface;

an upper guide surface spaced apart from the lower guide surface in an upward direction than a height between the lower curved surface and the upper curved surface, and defined in an arc shape having a diameter larger than that of the upper curved surface; and a plurality of rotation limiting guide surfaces connecting both ends of each of the lower guide surface and the upper guide surface to limit a front-rear direction rotation angle of the guide protrusion.

14. The robot cleaner of claim 12, wherein an upper end portion of the guide groove is defined in a semicircular shape, and the upper curved surface of the guide protrusion rotationally moves along a circumferential direction from one side of the upper end of the guide groove toward a top peak of an arc, and a front-rear inclination of the suction nozzle is automatically adjusted to be horizontal.

15. A robot cleaner, comprising:

a cleaner body provided with a protruding portion therein, and a plurality of guide protrusions protruding from both sidewalls of the protruding portion; and a suction nozzle that accommodates an agitator therein-side, provided with guide grooves concavely disposed on both sidewalls in a length direction to accommodate the plurality of guide protrusions, respectively, and mounted to be ascendable/descendable and swingable in a front-rear direction with respect to the cleaner body, wherein the guide groove ascends or descends and rotates in a front-rear direction while accommodating the guide protrusion to be brought into contact with the guide protrusion so as to limit an ascending/descending distance and a rotation angle of the guide groove.

16. A robot cleaner, comprising:

a cleaner body provided with a plurality of guide holes therein; and a suction nozzle provided with guide protrusions protruding from both sidewalls in a length direction toward the plurality of guide holes, respectively, to be accommodated inside the plurality of guide holes, respectively, so as to be ascendable/descendable and swingable in a front-rear direction with respect to the cleaner body, wherein the plurality of guide holes limits an ascent/descent and a front-rear rotation angle of the guide protrusion.

17. The robot cleaner of claim 1, further comprising:

a buffer member on an outer surface of the guide protrusion to relieve an impact when brought into contact with the guide groove.

* * * * *